US007056187B2

(12) United States Patent
Cassity

(10) Patent No.: US 7,056,187 B2
(45) Date of Patent: Jun. 6, 2006

(54) BACKLESS BRA

(76) Inventor: Michelle Cassity, #204, 605 - 14th Ave. S.W., Calgary, Alberta (CA) T2R 0M9

( * ) Notice: Subject to any disclaimer, the term of this patent is extended or adjusted under 35 U.S.C. 154(b) by 19 days.

(21) Appl. No.: 10/844,370

(22) Filed: May 13, 2004

(65) Prior Publication Data

US 2005/0255790 A1 Nov. 17, 2005

(51) Int. Cl.
*A41C 3/00* (2006.01)

(52) U.S. Cl. ..... 450/88; 450/60

(58) Field of Classification Search ..... 450/1, 450/59–64, 81–88; 2/67, 309–311, 338, 2/271

See application file for complete search history.

(56) References Cited

U.S. PATENT DOCUMENTS

| | | | | |
|---|---|---|---|---|
| 1,167,741 | A * | 1/1916 | Clarke | 450/56 |
| 2,406,699 | A * | 8/1946 | Lustig | 450/64 |
| 2,475,893 | A * | 7/1949 | Hayes | 450/64 |
| 2,688,749 | A * | 9/1954 | Cocks | 450/83 |
| 3,276,449 | A * | 10/1966 | Morgan | 450/81 |
| 3,306,299 | A * | 2/1967 | Paramore | 450/81 |
| 3,465,754 | A * | 9/1969 | Lockwood et al. | 450/1 |
| 3,710,800 | A * | 1/1973 | Carey | 450/64 |
| 5,797,786 | A * | 8/1998 | Smith et al. | 450/1 |
| 6,406,353 | B1 * | 6/2002 | Harper | 450/57 |
| D470,994 | S | 3/2003 | Valentin | D2/706 |
| D478,406 | S | 8/2003 | Valentin | D2/706 |
| 6,666,747 | B1 * | 12/2003 | Buntz | 450/81 |
| 2003/0073378 | A1 | 4/2003 | Davis | 450/88 |

FOREIGN PATENT DOCUMENTS

| | | |
|---|---|---|
| EP | 1386548 | 12/2002 |

* cited by examiner

*Primary Examiner*—Gloria M. Hale
(74) *Attorney, Agent, or Firm*—Ogilvy Renault LLP

(57) ABSTRACT

A backless bra. The backless bras has an elongate strap formed with a loop at each end. Each loop is configured for positioning about the breast of a user with strap material, therebetween positioned about the back of a user's neck.

20 Claims, 2 Drawing Sheets

BACKLESS BRA

FIELD OF THE INVENTION

This invention relates to a backless bra and more particularly, to a backless bra having removable support straps for enhancing the appearance of the breasts of the user.

BACKGROUND OF THE INVENTION

The prior art has a panoply of various modifications of the conventional bra design. Many of these designs are either strapless, backless or combinations of these.

In many instances, the existing bra arrangements present difficulties when the user wishes to wear specific garment designs which are either backless or strapless. The existing arrangements present complications in that where the dress or other garment has no back material, the present arrangements make it extremely difficult for the user to wear a bra in this situation. In the prior art, numerous attempts at alleviating these problems have been promulgated. Typical of the prior art arrangements is that which is disclosed in U.S. Patent Application Publication No. U.S. 2003/0073378, published Apr. 17, 2003, to Davis for a backless, strapless bra with swivel snap system. In the arrangement disclosed, Davis teaches a bra arrangement without straps or a back which includes two cups and a connector. The connector is adapted to facilitate swiveling of the cups relative to the connector to thereby conform to the shape of the user. The cups include inside and outside surfaces, with the inside surface including adhesive tape to assist in retention of the cups on the breasts. This arrangement although useful, does not provide any real support or allow the user to enhance her appearance.

In European Patent Application No. 1386548, Chen et al. disclose an improved backless strapless bra where the arrangement provides a connector for bra cups which has the capacity for variation to a variety of configurations.

This arrangement, globally, is very similar to that discussed herein previously regarding the United States Publication. There is still the need for a cup system in order to provide the necessary support.

U.S. Des. Pat. Nos. D478,406 and D470,994 issued to Valentin, provide further variations on the strapless and backless arrangements.

In view of the prior art, it would be desirable to have a backless bra which could provide a user with the necessary support and the ability to enhance her appearance without the use of bra cups and with the least amount of material as possible.

SUMMARY OF THE INVENTION

The present invention is directed to solving the drawbacks in the prior art arrangements and accordingly, one object of the present invention is to provide an improved bra.

A further object of one embodiment of the present invention is to provide a backless bra, comprising an elongate strap formed with a loop at each end, each said loop configured for positioning about the breast of a user with strap material, therebetween positioned about the back of a user's neck.

The loop arrangement allows the user to increase the degree of push up as desired and the provision of the support section greatly contributes to appearance enhancement and support.

As a particularly convenient feature, the support straps are removable and may be disposed of, depending upon the material chosen for these straps.

A further object of one embodiment of the present invention is to provide a backless bra, comprising an adjustable elongate strap having free ends for positioning about a user's neck; a support strap for positioning about the underside of each breast; and connecting straps for connecting each said support strap and said adjustable elongate strap whereby connected straps form a loop at each end of said free ends, each said loop configured for positioning about the breast of a user.

The adjustable features may be achieved using existing adjusting clips well known in this art. Additionally, it will be understood that the individual sections of the straps may be integrated by adjustable clips or may be fixed or no adjustment, depending on the intended use of the bra. Fixed or "no clip" arrangement would be, for example, particularly useful for athletic purposes such as running, tennis etc.

A further object of one embodiment of the present invention is to provide a backless bra, comprising an elongate strap having free ends, a support strap for positioning about the underside of each breast, first connection means for connecting a free end of said elongate strap with a respective free end of said support strap, a third strap for joining a second free end of said elongate strap with a second free end of said support strap, and second connection means for connecting said second free end of said of said elongate strap and said second free end of said support strap.

In the above-noted embodiment, the loops may be replaced by a bridging or connecting strap which connects between the support straps. In this manner, the user can augment or decrease the degree of cleavage as desired while facilitating the possibility of wearing lower neckline clothing.

Having thus generally described the invention, reference will now be made to the accompanying drawings.

BRIEF DESCRIPTION OF THE DRAWINGS

Similar numerals denote similar elements.

DETAILED DESCRIPTION OF THE PREFERRED EMBODIMENTS

Figure 1:
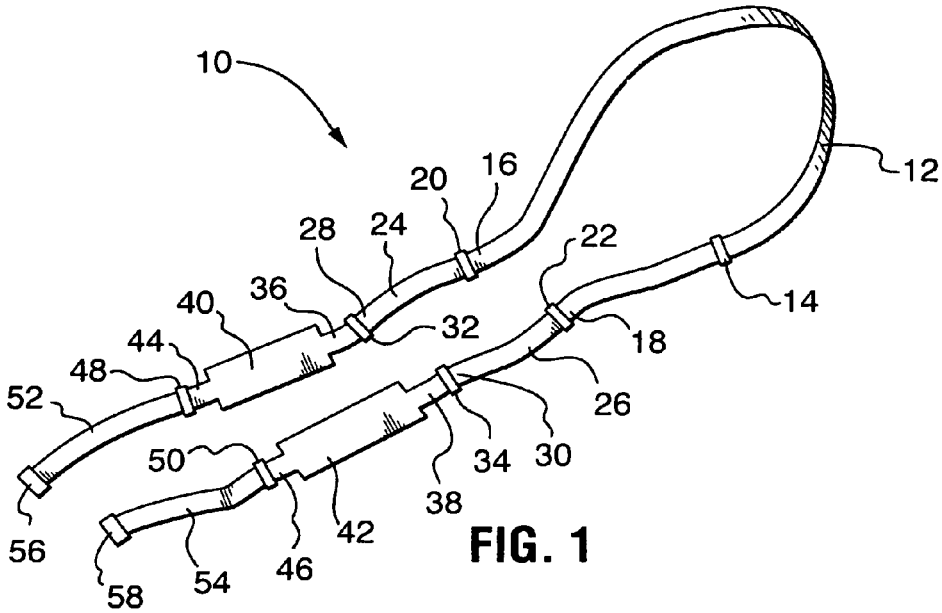
FIG. 1 is a perspective view of one embodiment of the present invention with the strap in a non-assembled form.
Figure 2:
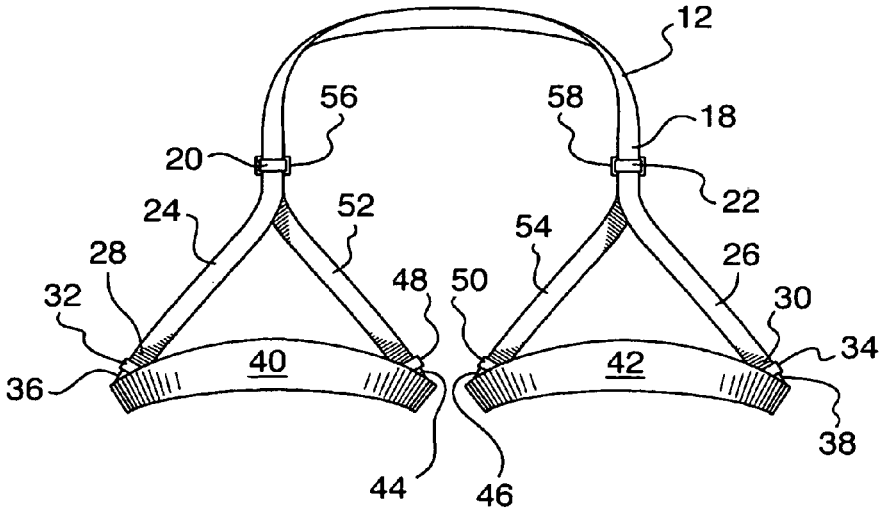
FIG. 2 is a view of the arrangement as assembled.
Figure 3:
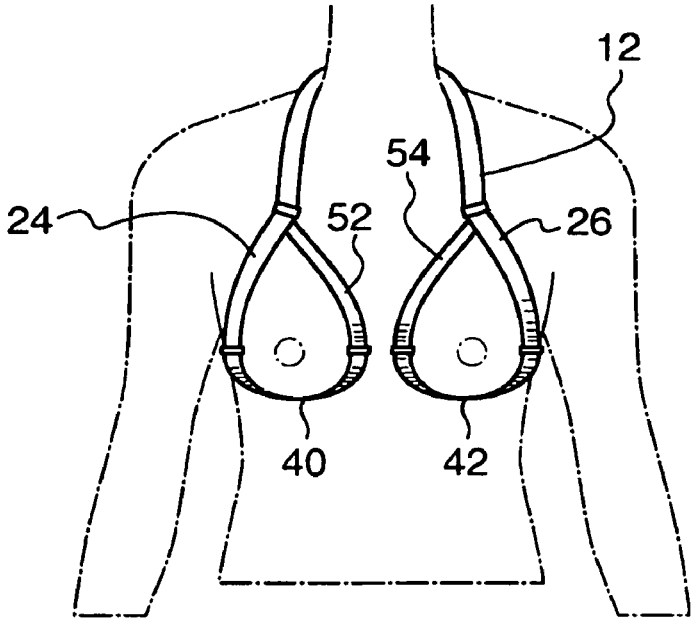
FIG. 3 is a perspective view of the strap in use about a user.

Referring initially to FIGS. 1 through 3, FIG. 1 illustrates the backless bra system as an elongate strap, globally denoted by numeral 10. The bra comprises a first strap 12 with a conventional adjustment buckle or clip 14 positioned along the length of the strap 12. The strap 12 includes ends 16 and 18 which ends are either affixed or adjustably connected with hooks, clips or other connection means, illustrated in the figure and denoted by numerals 20 and 22. Connected thereto are further linking straps 24 and 26. Each of straps 24 and 26 includes a respective free end, 28 and 30 each of which includes a connecting member 32 and 34, respectively (the connected member can be selected from those discussed herein previously) which releasably engage a free end 36 and 38, respectively of support straps 40 and 42. The support straps 40 and 42 are positioned for contact with the underside of the breast of a user as shown in FIG.

3 and in this manner act to lift and support the breasts. The individual straps 40 and 42 may be of a slightly greater dimension in width relative to the elongate strap 12 or other straps of the bra.

Each strap 40 and 42 includes a free end 44 and 46, respectively to which is attached at each end a connecting member 48 and 50, respectively. Extending from the connecting members 48 and 50 are further straps 52 and 54 each of which includes a connecting member 56 and 58, respectively. These connecting members 56 and 58 are adapted for connection with connecting members 32 and 34, respectively. In this manner, when assembled as illustrated in FIG. 2, the strap system forms a pair of loops which are adapted for positioning about the breasts of the user as illustrated in FIG. 3.

Returning to straps 40 and 42, as a particularly convenient feature, these straps are entirely removable from the system and may include adhesive material for imparting additional support when tension is exerted such as that which would be encountered by the strap 12 around the neck of the user as illustrated in FIG. 3. In this manner, the straps 40 and 42 may comprise any suitable material; however, it is desirable to have the same composed of a dermatalogically acceptable plastic material such that the same can be discarded after use. In this manner, in terms of replacement or reuse, the user could simply purchase these individual segments.

As an alternative, the straps may comprise a material which is washable. In this regard, the entire system 10 may be selected from the materials well known in the art for this purpose. To this end, the material may comprise elasticized cotton, polyester, spandex, inter alia.

Figure 4:
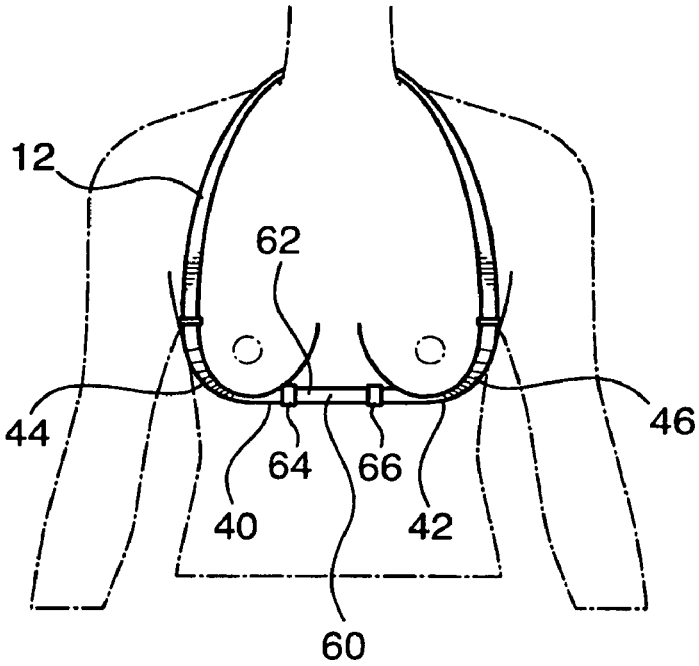
FIG. 4 is a further embodiment of the present invention.

Turning to FIG. 4, shown as a further embodiment of the present invention. In this arrangement the third strap 60 having free ends 62 and 64 joins free ends 44 and 46 with connection means 64 and 66, respectively. The connection means 64, 66 may be integral with the straps 40, 42 or may be included on the third strap 60 as an alternative. In terms of the third strap, the material may be any suitable form of material which may also include the elasticizing discussed with respect to the previous embodiment illustrated in FIGS. 1 through 3.

As set forth herein above, the connection points between the straps can be achieved using any of the conventional "S" type fasteners or any other suitable hook and eye type connection well known in the undergarment industry.

Although embodiments of the invention have been described above, it is limited thereto and it will be apparent to those skilled in the art that numerous modifications form part of the present invention insofar as they do not depart from the spirit, nature and scope of the claimed and described invention.

I claim:

1. A backless bra, comprising:

an elongate strap formed with a loop at each end, said elongate strap including a plurality of linked straps;

each said loop configured for positioning about the breast of a user with strap material, therebetween positioned about the back of a user's neck, said linked straps include a neck strap, a pair of support straps for positioning about the underside of each breast and adjustable connecting straps for connecting said support straps and said neck strap, said support straps and connecting straps forming a loop at each end of said neck strap.

2. The bra as set forth in claim 1, wherein each said loop includes adjustment means for adjusting loop size.

3. The bra as set forth in claim 1, wherein each said loop includes a support section for contacting the underside of the breast.

4. The bra as set forth in claim 3, wherein said support section comprises strap material having a greater width relative to the remaining strap material.

5. The bra as set forth in claim 3, wherein said support section of each said loop is releasably connected to said elongate strap.

6. The bra as set forth in claim 5, wherein said support section is disposable.

7. The bra as set forth in claim 5, wherein said support section includes adhesive material.

8. The bra as set forth in claim 1, wherein said strap material comprises an elastically deformable material.

9. The bra as set forth in claim 1, wherein said strap material comprises synthetic material.

10. The bra as set forth in claim 1, wherein said strap material comprises natural material.

11. A backless bra, comprising:

an adjustable elongate strap having free ends for positioning about a user's neck;

a support strap for positioning about the underside of each breast, said support strap having a greater width dimension relative to said elongate strap; and connecting straps for connecting each said support strap and said adjustable elongate strap, said connecting straps including adjustment means whereby connected straps form a loop at each end of said free ends, each said loop configured for positioning about the breast of a user.

12. The bra as set forth in claim 11, wherein said support strap is disposable.

13. The bra as set forth in claim 11, wherein straps of said bra comprise at least in part natural material.

14. The bra as set forth in claim 11, wherein straps of said bra comprise at least in part synthetic material.

15. A backless bra, comprising:

an elongate strap having free ends;

a support strap for positioning about the underside of each breast;

first connection means for connecting a free end of said elongate strap with a respective free end of said support strap;

a third strap for joining a second free end of said elongate strap with a second free end of said support strap; and second connection means for connecting said second free end of said of said elongate strap and said second free end of said support strap.

16. The bra as set forth in claim 15, wherein said support strap has a greater width dimension relative to said elongate strap.

17. The bra as set forth in claim 15, wherein each said support strap includes an adhesive material for contacting said underside of each breast.

18. The bra as set forth in claim 15, wherein each said support strap is disposable.

19. The bra as set forth in claim 15, wherein each said support strap includes cooperative releasable connection means for connection with said first connection means and said second connection means.

20. The bra as set forth in claim 15, wherein said third strap comprises an elasticized material for drawing support straps together.

* * * * *